US008646231B2

(12) United States Patent
Eyme

(10) Patent No.: US 8,646,231 B2
(45) Date of Patent: Feb. 11, 2014

(54) ALUMINUM PROFILES FOR OFFICE WALL SYSTEM (PARTITIONS) AND METHOD OF ASSEMBLY

(75) Inventor: Florian Eyme, Lyons (FR)

(73) Assignee: Dynamic Hive, Inc., Columbia, MD (US)

( * ) Notice: Subject to any disclaimer, the term of this patent is extended or adjusted under 35 U.S.C. 154(b) by 235 days.

(21) Appl. No.: 13/173,059

(22) Filed: Jun. 30, 2011

(65) Prior Publication Data

US 2012/0023855 A1 Feb. 2, 2012

Related U.S. Application Data

(60) Provisional application No. 61/368,330, filed on Jul. 28, 2010.

(51) Int. Cl.
*E04B 1/38* (2006.01)

(52) U.S. Cl.
USPC ..... 52/282.4; 52/272; 52/275; 52/282.3; 52/238.1; 52/239; 52/241

(58) Field of Classification Search
USPC ..... 52/282.4, 272, 275, 282.3, 282.5, 52/238.1, 239, 241, 204.1, 205, 204.5, 52/204.54, 214, 204.595, 204.71
See application file for complete search history.

(56) References Cited

U.S. PATENT DOCUMENTS

| | | | | | |
|---|---|---|---|---|---|
| 4,129,163 | A * | 12/1978 | Johnson | 160/135 |
| 4,446,669 | A * | 5/1984 | Siegal | 52/586.1 |
| 4,750,305 | A * | 6/1988 | Bastian | 52/127.11 |
| 5,379,518 | A * | 1/1995 | Hopper | 29/897.312 |
| 5,546,718 | A * | 8/1996 | Way | 52/238.1 |
| 2001/0004817 | A1 * | 6/2001 | Auer | 52/238.1 |

* cited by examiner

*Primary Examiner* — Mark Wendell
(74) *Attorney, Agent, or Firm* — Obler, Kaler, Grimes & Shriver; Royal W. Craig

(57) ABSTRACT

The connection between two partitions of offices is assured by a post of angle and a spacer. The section of the post of angle contains a circular part and a neighboring part in the shape of dovetail. The spacer is a profile, a section of which corresponds to a truncated triangle. The base and the extremities of the sides of the spacer contact the circular part of the post of angle. This contact assures of one part the alignment of both profiles and on the other hand a finish of joint whatever is the angle between partitions. The fixation of an element of partition such as one profile (22) or a facing in the U profile is assured by an intermediate profile snapped up at the bottom of U of the U profile. The fixation of a profile in a U profile is realized by insertion of the extremity of the profile in the hollow of U followed by a rotation of a quarter of tour of the profile around its main axis to clamp its extremity in the U.

16 Claims, 2 Drawing Sheets

ALUMINUM PROFILES FOR OFFICE WALL SYSTEM (PARTITIONS) AND METHOD OF ASSEMBLY

CROSS-REFERENCE TO RELATED APPLICATIONS

This application is related to U.S. Provisional Patent Application No. 61/368,330, entitled Aluminum Profiles For Office Wall System (Partitions), which application is incorporated in full in this application as if set forth in its entirety herein.

STATEMENT REGARDING FEDERALLY SPONSORED RESEARCH

Not Applicable.

BACKGROUND OF THE INVENTION

The invention concerns profiles of partitions for offices, more particularly a process of connecting those partitions using these profiles, in the process of fixation of an element to a U-profile of partition and a process of fixation (binding) of a profile in a corner pole of partition.

Diverse concepts of connecting of partitions of office (desk) are known, in particular for the connecting of partitions with another angle than 90°. The document U.S. Pat. No. 4,493,172 for example reveals a profile serving as post of connecting for various angles, namely 180° (that is aligned), 150°, 120° or 90°. This post is generally made with circular sections and contains a series of vertical grooves spaced out regularly and in which the extremities of corresponding shape of another profile, assuring the connection of the post to the partition. This concept allows certainly to link partitions according to various angles but it contains however the following inconveniences:

Angles are predefined what limits strongly the freedom of location of partitions. There is indeed a demand for not conventional layouts of office premises, which is where the various partitions are several times brought to present not conventional relative angles.

Furthermore, the concept described above is rather binding from the point of view of the assembly. This one indeed requires engaging the post with one or several intermediate profiles by sliding on all the length.

The invention tries to propose a concept mitigating these problems.

BRIEF SUMMARY OF THE INVENTION

According to a first aspect of the invention, a process of connecting the partitions of office is proposed, according to the following stages:

Lay a first profile (essentially vertical) at the end of a first partition;

Lay the second profile (essentially vertical) at the end of a second partition to be linked with the first one;

Characterized by

Realize the connecting between the first and the second partition by bringing the first profile in touch with the second profile and by fixing them; the section of the first profile including an essentially circular shape and the section of the second profile corresponding essentially to a truncated triangle whose truncated extremities and the base marry the circular section of the first profile.

Preferentially the fixation includes the screwing of the base of the second profile in the circular section of the first profile.

Preferentially the section of the first profile includes a part in the shape of dovetail neighboring the circular part.

Preferentially the part with the shape of dovetail of the first profile is sized so as to marry one of the sides of the second profile when both profiles are in contact and form a joint of 90°.

Preferentially the base of the second profile contains a set-back central section with regard to the main plan of the base.

Preferentially the base of the part with a dovetail of the first profile contains a set-back central section with regard to the main plan of the base.

According to the first aspect of the invention, it is proposed that a first profile of connecting of partitions of office, characterized in the fact that its section contains an essentially circular section, capable of marrying a second profile, the section of which corresponds essentially to a truncated triangle. The extremity of the truncated angles and the base marry the circular section of the first profile.

According to the second aspect of the invention, it is proposed a process of fixation of an element in a U-profile of partition of office, characterized by the following stages:

Plan means of hanging at the bottom of the U section of the U profile;

Plan an intermediate profile intended to be accommodated in the hollow of U of the profile and containing an inside face intended to be accommodated against the bottom of U of the profile and an outside face, an intermediate profile having means of hanging on its inside capable of cooperating by snapping up with the means of collision of the profile as well as the means of hanging on its outside face;

Plan means of hanging on the element (6) to be fixed capable of cooperating with the means of hanging on the outside face of the intermediate profile;

Assemble the element, the intermediate profile and the other profile by snapping them up.

Preferentially the means of hanging contain at least an edge or a pin notched to cooperate with a notched pin or an edge respectively.

Preferentially the means of hanging are formed by extrusion.

Preferentially the element is one counters closed whose outside surface appears with the extremities of U of the profile and preferentially sized so as to leave a space free between each of its sides and the corresponding extremity of U of the profile.

Preferentially the intermediate profile has a section generally in the shape of H.

Preferentially the element is a glazing or a facing panel.

According to the third aspect of the invention is proposed a process of fixation of a profile of partition of office in a profile with U shape, following the stages:

Insert an extremity of the profile of partition into the section U of the profile; and Fix the profile to the other profile;

Characterized in the fact that:

The section of the profile contains a maximal dimension according to a first axis and a dimension according to a second perpendicular axis to the first one, the maximal dimension according to the first axis being upper to the dimension according to the second axis and slightly upper the width of the U of the U profile so as to assure an assembly of the profile in the U profile with tightening;

The profile is directed with regard to its main axis so as to the first axis of its section is aligned with the main axis of the U profile during the insertion of the profile in the U section; and By the later stage to rotate the profile with regard to its main axis about a quarter of tour so as to align the second axis of its section with the main axis of the U profile and to assure the tightening of the profile in the U of the U profile.

The foregoing features, and advantages set forth in the present disclosure as well as presently preferred embodiments will become more apparent from the reading of the following description in connection with the accompanying drawings.

BRIEF DESCRIPTION OF THE SEVERAL VIEWS OF THE DRAWINGS

In the accompanying drawings which form part of the specification:

The FIG. 1 is a view in section of the connecting of two partitions according to a first mode of the invention.

Figure 2:
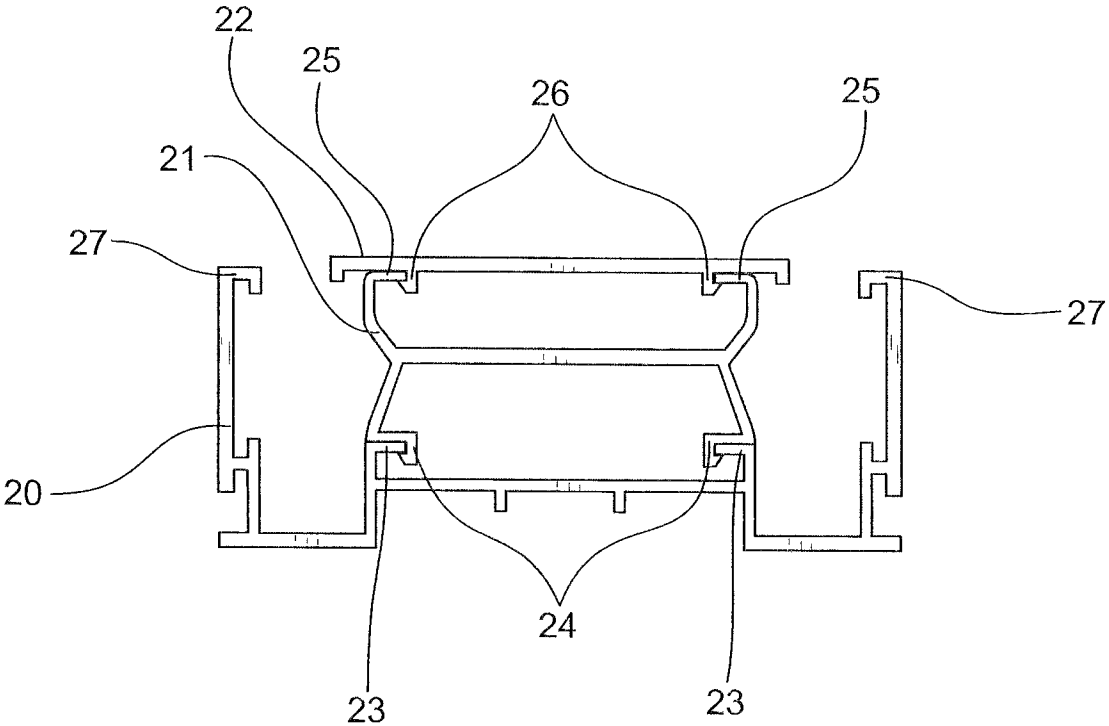

The FIG. 2 illustrates a U profile closed by means of an intermediate profile and one "pareclose" according to a second mode of the invention.

Corresponding reference numerals indicate corresponding parts throughout the several Figures of the drawings. It is to be understood that the drawings are for illustrating the concepts set forth in the present disclosure and are not to scale.

Before any embodiments of the invention are explained in detail, it is to be understood that the invention is not limited in its application to the details of construction and the arrangement of components set forth in the following description or illustrated in the drawings.

DETAILED DESCRIPTION OF THE ILLUSTRATIVE EMBODIMENT

The following detailed description illustrates the invention by way of example and not by way of limitation. The description enables one skilled in the art to make and use the present disclosure, and describes several embodiments, adaptations, variations, alternatives, and uses of the present disclosure, including what is presently believed to be the best mode of carrying out the present disclosure.

Figure 1:
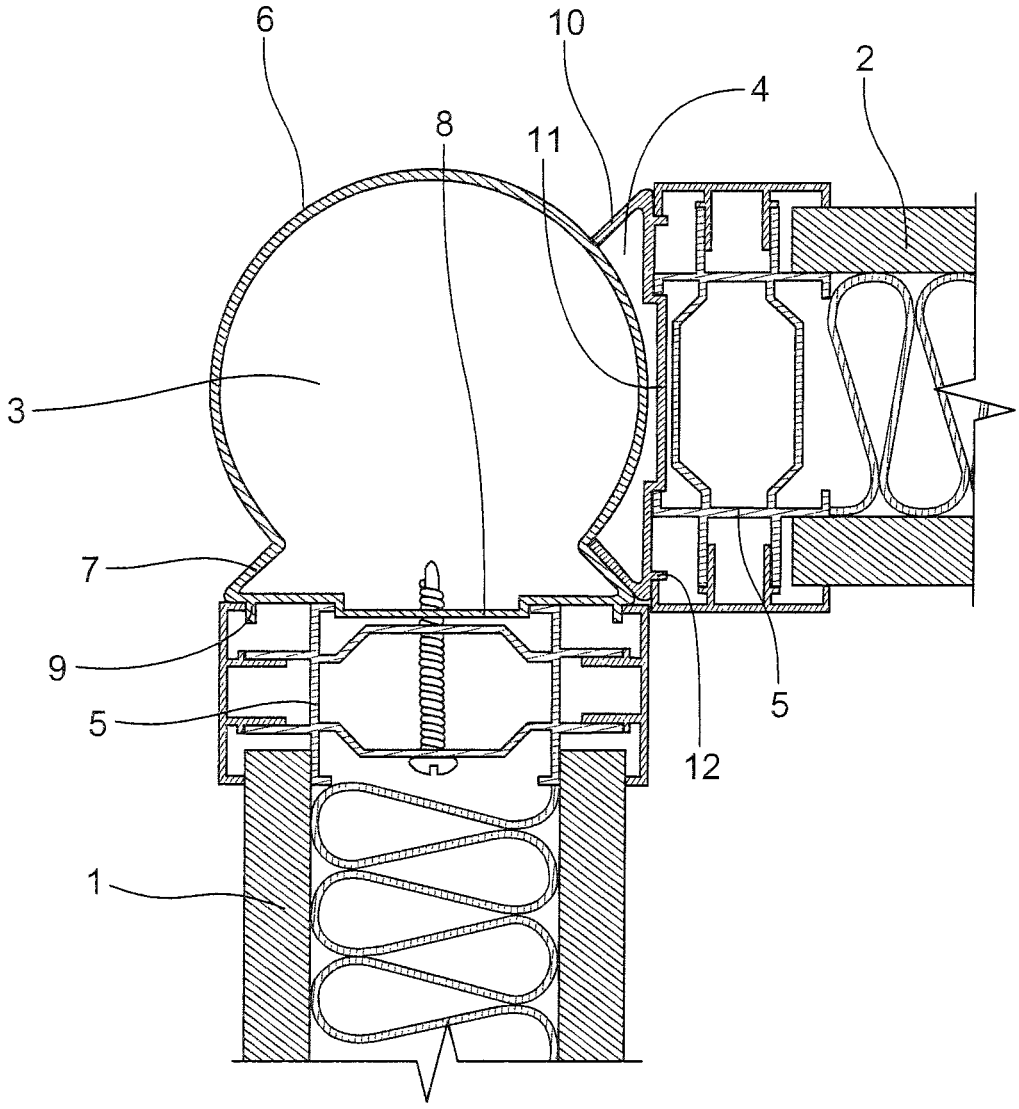

The FIG. 1 shows two partitions 1 and 2 linked according to a 90° angle by means of a first profile 3 called angle post and a second profile 4 called spacer. The partition 1 is connected with the post of angle by means of an intermediate profile 5. It's the same for the partition 2.

The section of the angle post has an essentially circular part 6 and another neighboring part 7 in the shape of dovetail. This section is constant on all the height of connecting of the post. The base of the part in the shape of dovetail is essentially rectilinear. It presents however a section 8 centered on the axis of symmetry of the set back the section with regard to the general plan of the base. This point creates a bossage seen from the outside by the post. It allows centring the intermediate profile 5. The outside of the base of the post 3 presents two pins 9 near the extremities of this one. They also allow a precise location of masks fixed to the intermediate profile 5. The post 3 such as described and illustrated in the FIG. 1 is preferentially made by extrusion of aluminum.

The section of the spacer corresponds to a truncated triangle, that is a triangle of which we cut one of the summits and a part both quoted forming this summit. More generally, the spacer contains an essentially flat base with two oblique faces 10 in the extremities of the base. The length of the base corresponds to the heights of the section of the post which corresponds to the diameter of the circular part 6 of the post 3. The base is essentially rectilinear. It presents however a section 11 centered on the axis of symmetry of the set back section with regard to the general plan of the base. This retreat creates a bossage seen from the outside of the spacer. He allows the centering of the intermediate profile 5. The outside of the base of the spacer presents two pins 9 near the extremities of this one. They also allow a precise location of masks fixed to the intermediate profile 5. Oblique sides 10 present the same angle with regard to the base. The angle and the length of oblique sides 10 are chosen so as to have the spacer marry the post. More particularly, the extremity of oblique sides and the middle of the part 11 of the base which is set back contact the circular part of the post 3. Seen by face, the contact of oblique sides defines two straight lines generative of the cylinder formed by the circular part of the post. It is this contact which assures the alignment of the spacer with regard to the post. It can be worthwhile that the part 11 of the base which is set back comes in touch with the post only when it is subjected to a certain effort. Indeed, although not represented, the fixation of the spacer 4 in the post 3 is realized by means of a screw arranged similarly than the linking of the intermediate profile 5 to the post 3. These means of fixation allow to put oblique sides in pressure against the post and thus assure a perfect finish of assembly.

In the FIG. 1, the angle between partitions is 90°. In that case, the oblique under side of the spacer 4 is in touch with the corresponding part 7—in the shape of dovetail—of the post 3. The respective edges of the spacer and of the post are in contact and realize a finish of irreproachable angle.

The FIG. 2 illustrates a concept of fixation of an element such as an element of closure or counters closed in a U profile. This type of profile is usually used in the partitions of office. Generally the other elements come to settle in the hollow of U of this profile but it is not always the case. In that case, it is necessary to close the opening of the profile. To do it, the profile 20 of partition is conceived so as to have two edges 23 at the bottom of U in the form of valleys extending along the main axis of the profile 20. An intermediate profile 21 the section of which is generally in the shape of H is planned. The legs of H each contain a picked pin 24 cooperating with edges 23 of the bottom of the U profile to assure a satisfactory fixation. The extremities of the legs of H also each contain a flat zone, parallel to the plan of the bottom of the U profile to assure a satisfying support on edges 23. In a similar way, the arms of H contain each an edge 25 parallel to the plan of the bottom of the profile. One other profile 22 contains two picked pins 26 intended to cooperate with edges 25 of the intermediate profile. In this way, the assembly of the profile 22 in approximate emergence with the extremities 27 of U is made particularly easy because it comes by the simple fitting of the profile 22, of the intermediate profile and of the profile of partition 20.

The means of collision are purely examples. Other systems are possible, in particular, we could imagine to invert pins and edges.

The profile 22 does not cover the totality of the opening of the U profile. Both free spaces between the profile 22 and the extremities 27 of the U profile are intended to receive hiding items, for example plastic.

Usually, U profile such as in the FIG. 2 are intended to be placed horizontally and to receive a glazing or a facing panel. In that case, the glazing or the panel comes to find accommodation in the intermediate profile accommodating the profile 22. Edges 25 then serve as means of location and hanging of the aforementioned glazing or the panel.

It is to note that the advantage of this concept is that no screwing is necessary. The assembly takes place by fitting or snapping up. Its the same for the dismantling.

Another aspect of the invention also stands in the mode of fixation of vertical profiles with regard to horizontal profiles. Indeed, the profile 20 in the FIG. 2 generally called U profile is intended to be installed horizontally, typically one fixed to the ground with the opening of U upward and one at the level of the upper edge of the partition and with the opening of U downward. The profile 5 in the FIG. 1 is typically a vertical profile intended to be fixed to U profile described this before. The length of the section of the vertical profile 5 is sized so as to be slightly superior to the internal width of the profile 20. The assembly takes place in the following way: the profile 5 is positioned so as to be parallel to the main axis of the U profile. Once in position, the profile 5 is manipulated by the installer so as to operate a rotation about a quarter of tour to bring the extremities of its section according to the length in touch with the insides of the U profile. Because of the calculated sizes of the U and of the profile 5, this last one, once in position, is in pressure in the superior and lower U profiles. The tightening is calculated so as to assure a satisfactory fixation of the profile. No screwing is necessary.

The use of the expression "partition for office" or "office wall system" does not constitute a restriction and is to be interpreted in the broad sense that is to say the principles described in this invention can apply to partitions in the other applications that those of the offices.

As various changes could be made in the above constructions without departing from the scope of the disclosure, it is intended that all matter contained in the above description or shown in the accompanying drawings shall be interpreted as illustrative and not in a limiting sense.

What is claimed is:

1. A method of connecting a first office partition (1) to a second office partition (2), comprising the steps of:

setting a first profile (3), essentially vertical, along an end of said first partition (1), said first profile (3) comprising a uniform cross-section defined by a partial circle section (6) interrupted by a protruding dovetail section (7);

setting a second profile (4), essentially vertical, along an end of said second partition (2), said second profile (4) comprising a uniform cross-section defined by a truncated triangle with a continuous base connecting a pair of opposing flat faces (10) converging obliquely from said base away from said second partition (2);

setting the oblique faces (10) of said second profile (4) edgewise in direct contact along the partial circle section (6) of said first profile (3);

affixing the base of said second profile (4) to the partial circle section (6) of said first profile (3);

affixing said second office partition (2) to the protruding dovetail section (7) of said first profile (3).

2. The method of connection of a first office partition (1) to a second office partition (2) according to claim 1, wherein said step of affixing the base of said second profile (4) to the partial circle section of said first profile (3) further comprises screwing the base of the second profile (4) into the partial circle section (6) of the first profile (3).

3. The method of connection of a first office partition (1) to a second office partition (2) according to claim 1, wherein the protruding dovetail section (7) of the first profile (3) converges into the partial circle section (6).

4. The method of connection of a first office partition (1) to a second office partition (2) according to claim 3, wherein said second office partition (2) comprises an intermediate profile (5) attached to the dovetail section (7) of the first profile (3).

5. The method of connection of a first office partition (1) to a second office partition (2) according to claim 4, wherein the base of the second profile (4) comprises a wall interrupted by a central set-back section (11).

6. The method of connection of a first office partition (1) to a second office partition (2) according to claim 1, wherein the protruding dovetail section (7) of the first profile (3) comprises flat sides diverging to a base, the base being interrupted by a central set back section (8).

7. An office partition assembly, comprising:

a first profile (3) comprising a uniform cross-section defined by a partial circle section (6) interrupted by a protruding dovetail section (7);

a first partition (1) attached along the dovetail section (7) of said first profile (3);

a second partition (2) attached to the partial circle section (6) of said first profile (3) by a second profile (4);

said second profile (4) comprising a uniform cross-section defined by a truncated triangle with a continuous base connecting a pair of opposing flat faces (10) converging obliquely from said base away from said second partition (2), said oblique faces (10) being in direct contact edgewise along the partial circle section (6) of said first profile (3), and the base of said second profile (4) being affixed to the partial circle section (6) of said first profile (3).

8. The office partition assembly according to claim 7, wherein the protruding dovetail section (7) of the first profile (3) converges into the partial circle section (6).

9. The office partition assembly according to claim 8, wherein the base of the second profile (4) comprises a wall interrupted by a central set-back section (11).

10. The office partition assembly according to claim 8, wherein the base of the second profile (4) is screwed into the partial circle section (6) of the first profile (3).

11. The office partition assembly according to claim 10, wherein the protruding dovetail section (7) of the first profile (3) comprises flat sides diverging to a base, the base being interrupted by a central set back section (8).

12. A method for fixation of a first profile (22) to a second profile (20) via a third intermediate profile (21) for connecting office partitions and the like, comprising the steps of:

positioning said second profile (20) comprising a uniform U-shaped cross-section having a hollow defined by opposing sides (23) joined at a bottom, and two spaced supports protruding from the bottom into the U of said second profile (20) to edges (23);

positioning said third intermediate profile (21) within the hollow of the U-shaped second profile (20), said third intermediate profile (21) comprising a uniform H-shaped cross-section having opposing sides joined at their middle, said sides extending from a first pair of opposing elbows for support against said first profile (22) to a second pair of opposing elbows for support against the spaced edges (23) of said second profile (20), said second pair of elbows extending to detent features adapted for snap-fit attachment to the edges (23) of said second profile (20); and attaching the first profile (22) to the intermediate profile (21), said first profile comprising a pair of detent features adapted for snap-fit attachment to the first pair of opposing elbows of said second profile (20).

13. The method of fixation according to claim 12, wherein said first profile, second profile and third profile are formed by extrusion.

14. The method of fixation according to claim 12, wherein said first profile (22) is suspended between the opposing sides (23) of the U-shaped cross-section without contacting said opposing sides (23).

15. The method of fixation according to claim 12, wherein the middle of the intermediate profile (21) is a flat wall section.

16. An extruded profile assembly for connecting office partitions, comprising:

a first profile (22) having a pair of detent features adapted for snap-fit attachment;

a second profile (20) comprising a uniform U-shaped cross-section having a hollow defined by opposing sides (23) joined at a bottom, and two spaced supports protruding from the bottom into the U of said second profile (20) to edges (23);

a third intermediate profile (21) attached inside the hollow of the U-shaped second profile (20), said third intermediate profile (21) comprising a uniform H-shaped cross-section having opposing sides joined at their middle, said sides extending from a first pair of opposing elbows attached to the detent feature of said first profile (22), to a second pair of opposing elbows for support against the spaced edges (23) of said second profile (20), said second pair of elbows extending to detent features adapted for snap-fit attachment to the edges (23) of said second profile (20).

* * * * *